United States Patent [19]

Stapleton

[11] Patent Number: 4,766,429

[45] Date of Patent: Aug. 23, 1988

[54] GRAPHIC SIMULATION SYSTEM

[75] Inventor: Alan L. Stapleton, Newbury, United Kingdom

[73] Assignee: Quantel Limited, Newbury, United Kingdom

[21] Appl. No.: 737,829

[22] Filed: May 24, 1985

[30] Foreign Application Priority Data

Jun. 22, 1984 [GB] United Kingdom ..... 8416039

[51] Int. Cl.[4] ..... G09G 1/00

[52] U.S. Cl. ..... 340/724; 340/723; 340/726

[58] Field of Search ..... 340/723, 724, 727, 729, 340/747, 726; 358/104

[56] References Cited

U.S. PATENT DOCUMENTS

| | | | |
|---|---|---|---|
| 3,778,811 | 12/1973 | Gicca et al. | 340/747 X |
| 3,976,982 | 8/1976 | Eiselen | 340/724 X |
| 3,988,728 | 10/1976 | Inoue et al. | 340/724 X |
| 4,117,473 | 9/1978 | Habeger, Jr. et al. | 340/724 |
| 4,484,192 | 11/1984 | Seitz et al. | 340/727 |
| 4,559,533 | 12/1985 | Bass et al. | 340/724 |

FOREIGN PATENT DOCUMENTS

| | | |
|---|---|---|
| 0104431 | 4/1984 | European Pat. Off. . |
| 0118255 | 9/1984 | European Pat. Off. . |
| 2070399 | 9/1981 | United Kingdom . |

*Primary Examiner*—Gerald L. Brigance
*Assistant Examiner*—Jeffery A. Brier
*Attorney, Agent, or Firm*—Cooper & Dunham

[57] ABSTRACT

A video graphic simulation system which is capable of producing an image of a panorama as viewed from different positions. To save storage space lines of video signals may be repeated at the edges of the view so that for example the view from a rolling vessel may be seen. Where simple repeating of lines may produce visible discontinuities alternate strips of video signals may be 'mirrored'.

14 Claims, 3 Drawing Sheets

| PROJECTION | V10 | V9 | V8 | V7 | V6 | V5 | V4 | V3 | V2 | V1 | V0 | STORE |
|---|---|---|---|---|---|---|---|---|---|---|---|---|
| 1 LINE | 1 | 1 | 1 | 1 | 1 | 1 | 1 | 1 | 1 | 1 | 1 | 1ST |
| 2 LINES | 1 | 1 | 1 | 1 | 1 | 1 | 1 | 1 | 1 | 1 | 0 | 2ND |
| 64 LINES | 1 | 1 | 1 | 1 | 1 | 0 | 0 | 0 | 0 | 0 | 0 | 64TH |
| 65 LINES | 1 | 1 | 1 | 1 | 0 | 1 | 1 | 1 | 1 | 1 | 1 | 64TH |
| 66 LINES | 1 | 1 | 1 | 1 | 0 | 1 | 1 | 1 | 1 | 1 | 0 | 63RD |

| | | | | | | | | | | | | |
|---|---|---|---|---|---|---|---|---|---|---|---|---|
| 1 LINE | 1 | 1 | 0 | 0 | 0 | 0 | 0 | 0 | 0 | 0 | 0 | |
| 2 LINES | 1 | 1 | 0 | 0 | 0 | 0 | 0 | 0 | 0 | 0 | 0 | |
| 64 LINES | 1 | 1 | 0 | 0 | 0 | 1 | 1 | 1 | 1 | 1 | 1 | |

GRAPHIC SIMULATION SYSTEM

This invention relates to a video graphic simulation system in which digital processing circuits generate or process electronically video signals which are capable of producing an image on a television type receiver.

A known form of such a system is one in which a store is provided for the storage of separate signal elements which collectively represent a panoramic view, and the elements can be selectively read from said store in raster format and displayed on an image display device so that the panorama is that perceived from a particular position or direction determined by the raster frame. This position or direction can be changed to simulate observations from a moving object by shifting the raster. With such a system a large panorama may be required to provide many different views and this may be very costly in storage, the video signals are usually provided in digital form and a very large density of digital words may be required over the whole panorama. The object of the present invention is to provide a facility of producing panoramic views at less cost in storage than in previous systems.

According to the invention there is provided a video graphic simulator comprising (a) a video signal store having a multiplicity of storage locations for storing signal elements which collectively represent a panorama, (b) means for reading signals from a raster of said storage locations so that the view framed by said raster can be reproduced, (c) said means including view selector means for selectively shifting said raster with respect to said storage locations so that said frame can represent views from different directions or positions, (d) the arrangement being such that said shift can cause the frame to project beyond the storage locations at least at one edge and (e) said reading means are arranged to fill the projecting part of the frame with video signals read from storage locations adjacent to the projecting edge.

The invention may find application, for example, when the field of view is a seascape and it is desired to represent a change in view from a rolling vessel. As the vessel rolls in one direction the amount of sky will increase. By repeating successive strips of sky at the top edge of the picture as mirror images of the next strip then the amount of storage needed to produce the effect desired can be reduced. Conversely if the ship rolls in the other direction the amount of sky viewed will decrease and the effect of the increase in the amounts of sea seen can be produced by repeating strips of the sea in the same way. A particular strip represented by signal elements in a number of lines (say 64) of storage locations can be "repeated" several times as the view changes. In cases where the image is such that repeating sections without mirroring would produce no noticeable discontinuities the mirroring may be omitted. Since the sea and sky may be amorphous or have irregular texture the effect of "mirroring" may hardly be noticeable. The invention is applicable to arrangements in which the image or images of an object can be superimposed on the panorama and the shifting of the raster frame is arranged to follow the movement of one or more of the moving objects as described in our co-pending British patent application No. 8320357 corresponding to U.S. patent application Ser. No. 633,321 filed on July 23, 1984.

So that the invention may be more clearly understood one example of this invention will be discussed with reference to the drawings.

FIGS. 3(*a*) and 3(*b*) represent examples of line addresses before decoding and after decoding.

Figure 4:
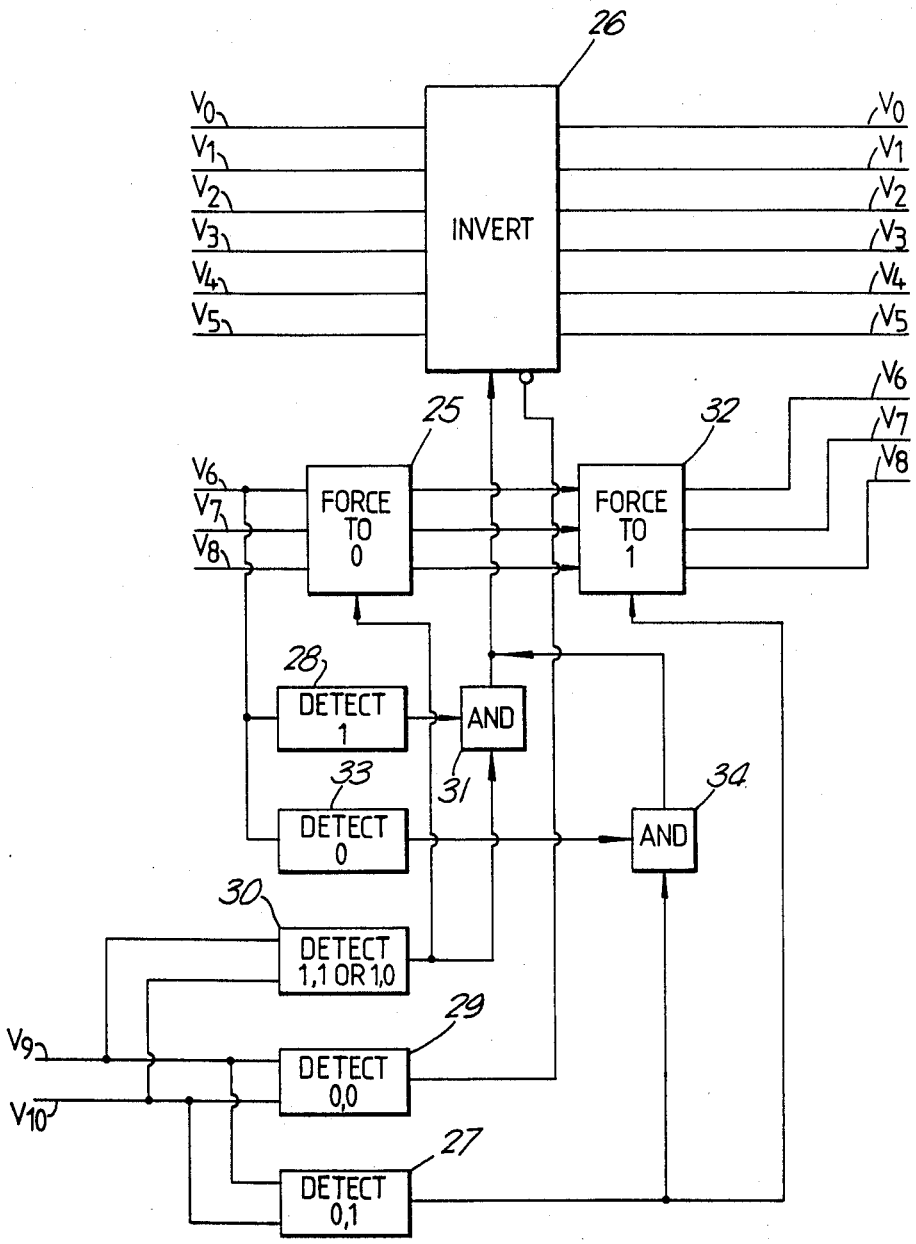

FIG. 4 represents the address bit decoder.

Figure 1:
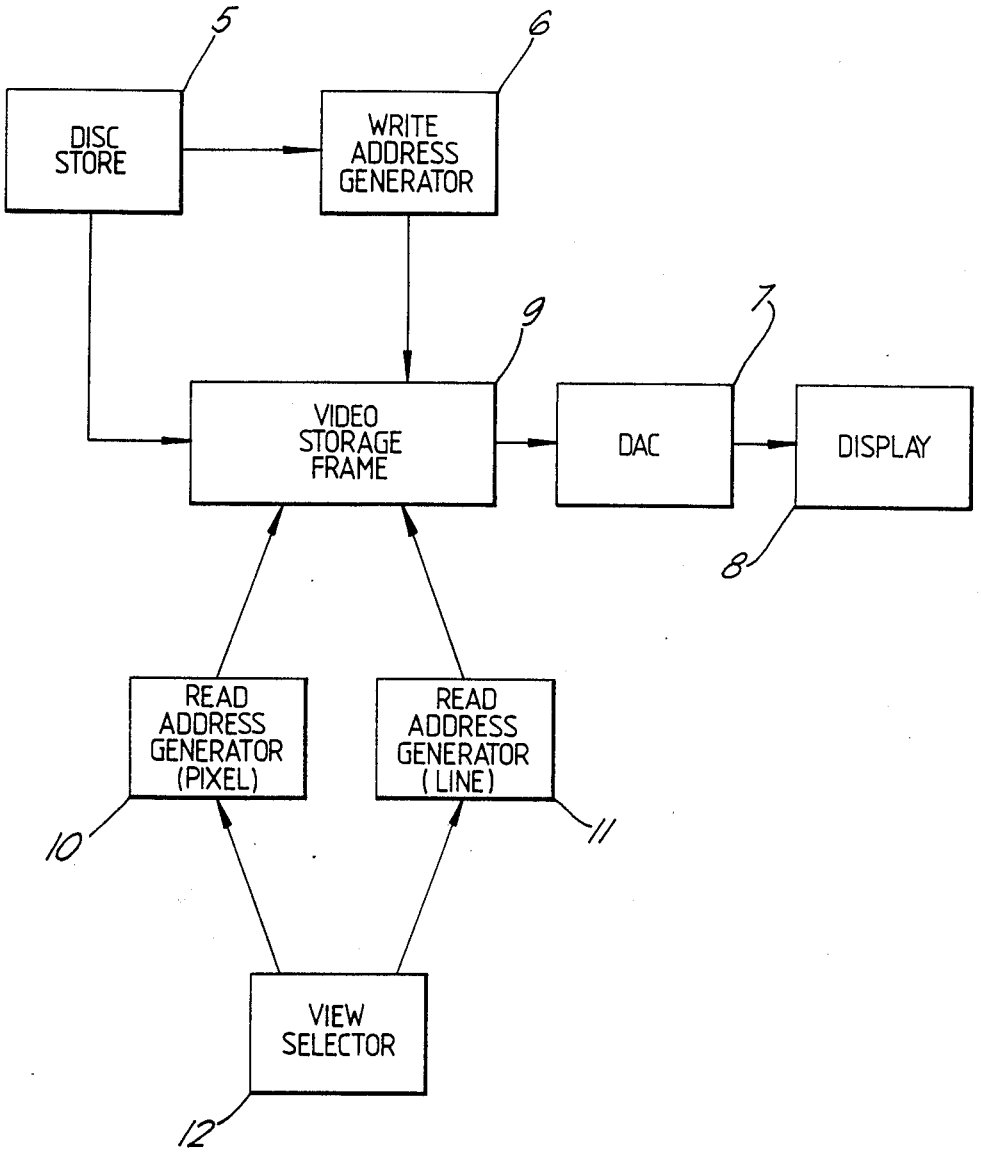
FIG. 1 represents a block diagram of this example.

In FIG. 1 the video signals representing the panoramic view are written into the frame store 9 from the disc store 5 at locations given by the write address generator 6. The store 9 in this example has 512 lines of storage locations, each line includes 512 storage locations. These components are all commercially known. The view selector 12 can be controlled manually or automatically in response to a computer and sets the co-ordinates of one corner of the raster frame which is to be displayed. This view selection is connected to two address generators one of which (10) addresses the pixels in a line and other of which (11) addresses the lines of the store. The line address generator addresses the lines of video signals that are read from the store 9 to generate one frame of display. The position of these lines will determine the vertical position in view. The pixel address generator generates the horizontal addresses in the storage locations from which video signals are taken to form each line. These lines can shift horizontally so that a horizontal change in the field of view can be represented. The invention is primarily concerned with the shift in the vertical position of the frame and the rest of the discussion will be confined to the operation of the invention with respect to this. The raster frame of video signals chosen by the view selector can be displayed on the display device 8 after being converted to analogue signals in the digital to analogue converter 7.

Figures 2, 3A, 3B:
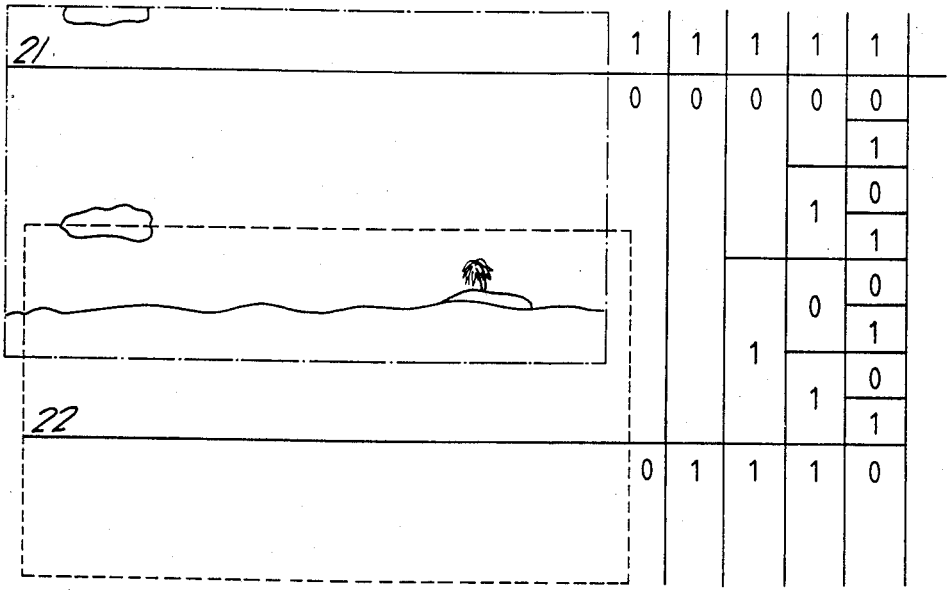
FIG. 2 represents an example of the final display on the screen with corresponding values of address bits.

In FIG. 2 reference 21 and 22 respectively represent the top and bottom lines of storage locations in the store 9 and may thus be said to represent the top and bottom edges of the store. The two lines are thus the first line and 512th line of the store (address 0 and address 511). In operation the address generator generates line addresses in the store 9 from which video signals are to be read to form the display in the display device. The store line addresses are generated in the time order in which respective lines are displayed by the display device. If the vertical position of the display frame, as determined by view selector 12, is central, so that it does not project beyond line 21 and 22 video signals will be read from the lines of store 9 in normal order beginning with the first line and ending with the 512th line with due regard to interlacing. If however, the display frame projects, say, above the top edge of the store the projecting part of the display frame has to be filled by lines of video signal read from the store 9 out of normal order. The frame of course will be filled before the reading process reaches the bottom edge 22 of the store 9. Similarly if the display frame projects below the bottom edge 22 of the store, reading from the store will start at some line of the store below top edge 21, whilst the projecting part of the frame will be filled by lines of video signal read from near the bottom of the store out of normal order.

The address generator 11 is programmed to operate in such a way that if view selector 12 indicates, say, that the reading frame projects say by 64 lines above the top edge of the store 9 the projecting frame is filled by addressing first line 63 of the store 9, then addressing line 62 and so on in reverse order down to line 0. Thereupon address generator re-addresses line 0, then line 1 and so on in normal order down to line 447, whereupon the display frame is filled. It will be understood of course that if there is interlacing the odd and even lines will be addressed in alternate field periods. If the extent of the projection of the display frame beyond top edge 21 is say 128 lines, the first address generated by the generator 11 is line 0 of the store, then line 1 and so on up to line 63, then 62, 61 etc are addressed. That is to say to fill the projecting part of the store the top 64 lines of the video signals in the store 9 are mirrored as many times as required to fill the frame. The situation is similar if frame projects beyond the bottom edge 22.

In FIG. 2 there is shown on the right, part of the address generated by the address generator to denote particular lines of the store, depending on the output of the view selector. Some complete addresses are shown in FIGS. 3(*a*) and 3(*b*). Each line address is a digital word of 11 binary digits and the two highest digits V9 and V10 are used to indicate whether or not the display frame projects beyond the top or bottom edges of the store 9, whereas the remaining nine digits V0–V8 denote actual lines of the store 9. When V9 and V10 are both 0 the remaining digits V8–V0 denote the store lines 0–511 in a conventional way. The lines above the top edge are given negative numbers and so if V9 and V10 are both 1, this denotes that the display frame projects beyond the top edge of the store; the remaining digits V8–V0 again denote respective store lines but according to a special convention. Similarly, if V10 is 0 and V9 is 1, projection beyond the bottom edge of the store is indicated and the remaining digits denote respective store lines according to another special convention. Value of the other digits V0–V5 are not indicated in FIG. 2 it is believed that they will be apparent (from the description) to a person skilled in the art.

To illustrate the address coding FIG. 3(*a*) indicates the addresses which will be generated by the address generator for the first line (the topmost line in the actual images as viewed) of the display frame when the frame projects beyond the top edge 21 by 1, 2, 64, 65 and 66 lines respectively. It is considered that the coding for the other lines will readily be appreciated. FIG. 3(*b*) shows the corresponding decoded addresses for the store lines for projections of 1, 2 and 64 lines, the said store line addresses now being 0, 1 and 63 in conventional binary as required. The convention for decoding is that digits V6–V8 are forced to value 0, if not initially 0, and that if V6 is initially 1, digits V0–V5 are inverted. If the display frame project more than 128 lines above the top edge of the store, digit V7 becomes 0, and if it projects more than 256 lines, digit V8 becomes 0. The display frame may project more than 512 lines above the top edge of the store in which case V9 will become zero, and the decoding will proceed as before. Addresses in the case where the display frame projects beyond the bottom edge 22 are generated in a similar manner, the decoding convention in this case being, however, that V6–V8 are forced to value 1, and that if V6 is initially 0, V0–V5 are inverted. If the display frame projects more than 64, 128, 256 lines below the bottom edge of the store, the digits V7, V7 and V8 change in value accordingly.

The decoding process in the address generator can be seen more clearly in FIG. 4. As stated before if the raster frame project above the store the digit V10 is set to one, because the addresses are negative and V9 may be one or zero. In the decoder this is decoded at 30, this activates the circuit 25 which sets V6 to V8 to zero. If V6 was originally 1 when the value of V10 was 1 then this is detected at 28 and the AND gate 31 which later produces an output which activates an inverting circuit 26 and V0 to V5 are inverted. This gives the projections at the top of the store. When the raster frame is not projecting from the store, V10 and V9 are zero which is detected at 29 and all the address digits are read as normal, inverting circuit 26 being transparent. If the raster frame projects at the bottom of the store then values of V10 and V9 are 0 and 1 respectively. This condition activates gate 27 which sets V8 to V6 to a value of 1 in circuit 32 and again the value of V6 is used to produce the mirroring of the lines. If V6 is originally zero this is decoded at 33 and the AND gate 34 produces an output which activates the inverting circuit 26. The lines are then written onto the screen in reverse order compared to the next strip. By the use of such a decoding method the desired projection effects may be achieved.

Several variations of the present invention are envisaged. The address generator could be such that the video signals used to fill a projecting frame could be taken from a portion of the store lines not included in the frame. The system could also be adapted so that the projecting edge was a vertical one and by mirroring pixels instead of lines the display could be extended sideways. The video signals used to fill the projecting frame of the store may in some cases be taken from storage locations not close to the edges of the store. Mirror imaging of the lines used to fill the projecting frame may be dispensed with in some cases.

A further variation is in the size of the raster frame defining the view selected. This may be such that the frame always projects across one or both edges of the store. In one example the frame is 576 lines deep and so 64 lines of the store need to be repeated even when the frame is central, 32 at the top and 32 at the bottom.

What is claimed is:

1. A video graphic simulator system comprising:

(a) video signal store means having a multiplicity of storage locations for storing at least one stored frame of video signals which collectively represent a panorama;

(b) display means for displaying a display frame of signals representing a view of the panorama;

(c) view selector means for selecting the view to be displayed, including means for positioning said display frame with respect to said stored frame to cause a part of the display frame to project beyond the stored frame at least at one edge of the panorama, wherein said view selector means is operator controlled; and (d) reading means for reading, from said store means, video signals which are within said stored frame to said display means, said reading means including means to fill said part of the display frame which projects beyond the stored frame with video signals read from storage locations for video signals representing a selected region of said stored frame which is adjacent to said at least one edge of the panorama;

wherein said reading means further includes address generating means to generate addresses of storage locations which store video signals to be used to fill said part of the display frame which projects beyond the stored frame, said address generating means being controlled by said view selector means;

wherein said address generating means includes means for determining the position of the display frame with respect to the stored frame, and said address generating means generates the addresses of the video signals to be read to fill the projecting part of the display frame in response to the determined position of that frame; and wherein said address generating means generates addresses causing a plurality of lines of video signals to be read to fill said projecting part of the display frame in such a manner as to produce a mirror image of the stored frame represented by the plurality of lines therein adjacent said at least one edge of the panorama represented thereby.

2. A method of video graphic simulation comprising:

storing, in a plurality of storage locations, video signals representing a panorama;

displaying a display frame of signals representing a view of the panorama;

selectively positioning said display frame with respect to said storage locations so that the required view may be seen, said positioning being such that the display frame has a part projecting beyond the storage locations at least at one edge of the panorama; and reading video signals from said storage locations contained within a selected region of the stored frame to fill the projecting part of said display frame;

wherein the video signals which fill said projecting part of the display frame comprise a plurality of lines in the form of a mirror image of video signals from said storage locations which represent a portion of the stored frame adjacent to said at least one edge of the panorama.

3. A video graphic simulator system comprising:

a store which stores at least one stored frame of video signals representing a stored view of a panorama;

a display which selectively displays a display frame of video signals representing a selected view of said panorama which may be different from the stored view;

a selector which selects a relative position between said stored and display frames at which they overlap but a part of the display frame projects beyond the stored frame at least at one edge of the stored view of the panorama, to thereby define said selected view of the panorama; and a circuit which reads video signals from a selected region of the stored frame and uses them to fill in said projecting part of the display frame;

wherein the video signals of the stored and display frames represent video lines, and in which said circuit reads lines from the stored frame which are adjacent at least one edge of the stored view of the panorama and uses them to fill in the adjacent projecting part of the display frame; and wherein the lines which are read from the stored frame to fill in the adjacent part of the display frame form, in the display frame, a mirror image of the adjacent part of the stored frame relative to said at least one edge of the stored view of the panorama.

4. A system as in claim 3 in which the store stores one or more stored frames representing said stored view of the panorama, and the selector successively selects different views of said stored panorama which simulate views from a craft moving around one or more axes relative to a panorama represented by the one or more stored frames.

5. A system as in claim 4 in which said selector is manually operable.

6. A video graphic simulation method comprising:

providing a stored frame of video signals representing a stored view of a panorama;

providing a display for displaying a display frame of video signals representing a selected view of said panorama which may be different from the stored view;

selecting a relative position between said stored and display frames at which they overlap but a part of the display frame projects beyond the stored frame at least at one edge of the stored view of the panorama, to thereby define said selected view of the panorama; and using video signals from a selected region of the stored frame to fill in said projecting part of the display frame;

wherein which the video signals of the stored and display frames represent video lines, and in which lines from the stored frame which are adjacent said at least one edge of the stored view of the panorama are used to fill in the adjacent projecting part of the display frame; and wherein the lines which are read from the stored frame to fill in the adjacent part of the display frame form, in the display frame, a mirror image of the adjacent part of the stored frame relative to said at least one edge of the stored view of the panorama.

7. A method as in claim 6 including providing one or more stored frames representing said stored view of the panorama, and successively selecting different views of said stored panorama which simulate views from a craft moving around one or more axes relative to a stored view of the panorama represented by the one or more stored frames.

8. A system as in claim 7 in which said selector is manually operable.

9. A video graphic simulator comprising:

(a) a frame store for storing digitally encoded pixels representing a panorama;

(b) selection means for reading pixels from said frame store and forming a video signal by including therein selected ones of the read pixels for each of a sequence of display intervals;

(c) a display receiving said video signal and displaying a sequence of complete frames based thereon; and (d) means for simulating movement of the displayed frame by causing the selection means to exclude from the video signal for the successive display intervals progressively more pixels at one edge of the frame included in the signal for a preceding interval and to repeatedly include other non-excluded pixels from said frame store at the opposite edge of the frame.

10. A simulator according to claim 9 wherein pixels are excluded from the video signal a line at a time to simulate vertical movement of the displayed frame.

11. A simulator according to claim 9 wherein pixels are included in the video signal more than once to create a mirror image of a selected region of the displayed frame.

12. A simulator according to claim 11 in which the frame is bounded by edges and the mirror image has a line of symmetry which is parallel to an edge of the frame.

13. A simulator according to claim 11 wherein the number of said other selected pixels cannot exceed a predetermined maximum number, and whereafter further movement is synthesized by including said other selected pixels in the video signal three more times.

14. A simulator according to claim 13 wherein the pixels other selected pixels are repeated in the displayed image as a series of mirror images.

* * * * *